US010449665B2

(12) United States Patent
Ernst

(10) Patent No.: US 10,449,665 B2
(45) Date of Patent: Oct. 22, 2019

(54) BIT ORGANIZER

(71) Applicant: Gregory R Ernst, Eagle Creek, OR (US)

(72) Inventor: Gregory R Ernst, Eagle Creek, OR (US)

( * ) Notice: Subject to any disclaimer, the term of this patent is extended or adjusted under 35 U.S.C. 154(b) by 0 days.

(21) Appl. No.: 15/945,608

(22) Filed: Apr. 4, 2018

(65) Prior Publication Data

US 2018/0319005 A1 Nov. 8, 2018

Related U.S. Application Data

(60) Provisional application No. 62/484,839, filed on Apr. 12, 2017.

(51) Int. Cl.
*B25H 3/00* (2006.01)
*B25H 3/06* (2006.01)

(52) U.S. Cl.
CPC ..... *B25H 3/003* (2013.01); *B25H 3/06* (2013.01)

(58) Field of Classification Search
CPC . B25H 3/003; B25H 3/06; B25H 3/04; B25H 3/027; B25H 3/028; B25H 3/021; B25H 3/023; A47F 7/0028
USPC ..... 211/69
See application file for complete search history.

(56) References Cited

U.S. PATENT DOCUMENTS 2,775,342 A * 12/1956 Smith ..... B25H 3/003 206/379
4,660,719 A * 4/1987 Peterson ..... B25H 3/003 206/372
4,958,732 A * 9/1990 Rau ..... B25H 3/003 206/379
5,525,314 A * 6/1996 Hurson ..... A61C 3/04 206/369
5,544,744 A * 8/1996 Oman ..... B25H 3/028 206/319
5,570,784 A * 11/1996 Sidabras ..... B25H 3/003 206/378
5,893,457 A * 4/1999 Wei ..... B25H 3/003 206/373
6,119,859 A * 9/2000 Wen ..... B25H 3/06 206/372
6,145,662 A * 11/2000 Newton ..... B25H 3/06 206/373
6,283,291 B1 * 9/2001 Vasudeva ..... B25H 3/003 206/373
6,547,074 B1 * 4/2003 Chen ..... B25H 3/003 206/379
6,571,966 B1 * 6/2003 Hsiao ..... A47F 7/0028 206/379
7,188,726 B2 * 3/2007 Lin ..... B25H 3/003 206/373
7,325,682 B2 * 2/2008 Seymour ..... B25H 3/003 206/379
7,364,041 B2 * 4/2008 Roesler ..... B25H 3/003 206/373
7,434,688 B2 * 10/2008 Hu ..... B25H 3/003 206/377

(Continued)

*Primary Examiner* — Patrick D Hawn
(74) *Attorney, Agent, or Firm* — patenttm.us

(57) ABSTRACT

A bit holder comprises a tray receiving rail members therein and bit holders mountable to the rail. The bit holders may be adapted to receive shorter driver bits therein, or alternatively adapted to receive elongate drivers therein.

10 Claims, 11 Drawing Sheets

(56) References Cited

U.S. PATENT DOCUMENTS 7,600,640 B2 * 10/2009 Hallee ..... B25H 3/003 206/373
8,069,984 B2 * 12/2011 Larson ..... B25H 3/023 206/372
8,875,884 B1 * 11/2014 Lee ..... B25H 3/04 206/1.5
9,156,156 B2 * 10/2015 Wang ..... B65D 25/107
9,364,949 B2 * 6/2016 Ernst ..... B25H 3/06
9,403,270 B2 * 8/2016 Lin ..... B25H 3/02
9,694,489 B2 * 7/2017 Steele ..... B25H 3/003
2003/0062279 A1 * 4/2003 Lam ..... A45C 13/02 206/350
2003/0213760 A1 * 11/2003 Lee ..... B25H 3/003 211/70.6
2003/0234196 A1 * 12/2003 Hu ..... B25H 3/04 206/372
2004/0069668 A1 * 4/2004 Finnigan ..... B25H 3/003 206/372
2004/0144671 A1 * 7/2004 Hallee ..... B25H 3/003 206/373
2004/0154942 A1 * 8/2004 Streich ..... A45C 5/00 206/349
2005/0126944 A1 * 6/2005 Wang ..... B25H 3/003 206/379
2005/0242145 A1 * 11/2005 Wang ..... A45F 5/021 224/666
2005/0247587 A1 * 11/2005 Holland-Letz ..... B25H 3/003 206/373
2006/0091032 A1 * 5/2006 Tsai ..... A45C 13/28 206/373
2009/0211932 A1 * 8/2009 Schmitt ..... B25H 3/003 206/373
2009/0266730 A1 * 10/2009 Lin ..... B25H 3/003 206/372
2009/0288974 A1 * 11/2009 Pistor ..... B25H 3/003 206/377
2010/0032327 A1 * 2/2010 Lai ..... B25H 3/003 206/375
2012/0000805 A1 * 1/2012 Liu ..... B25H 3/003 206/372
2013/0118938 A1 * 5/2013 Huang ..... B25H 3/00 206/372
2014/0165293 A1 * 6/2014 Hermansen ..... B25F 1/02 7/168
2014/0190853 A1 * 7/2014 Ernst ..... B25H 3/06 206/378
2016/0052125 A1 * 2/2016 Steele ..... B25H 3/003 206/372
2016/0332293 A1 * 11/2016 Meyers ..... B25H 3/006
2016/0339581 A1 * 11/2016 Brinkhuis ..... B25H 3/006
2017/0361454 A1 * 12/2017 Hsu ..... B25H 3/003

* cited by examiner

BIT ORGANIZER

CROSS-REFERENCE TO RELATED APPLICATIONS

This application claims benefit of U.S. provisional patent application Ser. No. 62/484,839 filed Apr. 12, 2017, entitled BIT ORGANIZER, the disclosure of which is incorporated herein by reference.

BACKGROUND

This disclosure relates to tools, and more particularly for apparatus and methods for holding tool bits for organization and ease of access.

Driver bits are commonly used to apply torque to screws, transferring torque from a screwdriver, powered driver tool, drill, or other tool, to a corresponding recess on top of a driven element, such as a threaded fastener. The fasteners might be as simple as a common screw, or more technical security fasteners that are designed to restrict adjustment or removal to those with more specialized bits. A typical user may have many sizes and configurations of bits, such as square drive, phillips (or plus or cross) drive, slot (or minus) drive, Torx® or security Torx®, hex, double square, triple square, polydrive, spline drive, double hex, bristol, pentalobe, etc. To be able to work with a variety of such fasteners, a user wants to carry a variety of bits in a tool box or bag, so as to be able to match any particular fastener that might be encountered in use. A way to organize and quickly find and access a variety of bits becomes necessary.

SUMMARY

In accordance with the disclosure, a bit organizer keeps a variety of size and configuration of bits organized and accessible, in the form of a universal tray that provides storage in a compact space and holds a wide range of bits. A unique design holds small bits upright on one side and holds mid to long bits sideways on another side to allow easy storage in a tool drawer.

The subject matter of the present technology is particularly pointed out and distinctly claimed in the concluding portion of this specification. However, both the organization and method of operation, together with further advantages and embodiments thereof, may best be understood by reference to the following description taken in connection with accompanying drawings wherein like reference characters refer to like elements.

DETAILED DESCRIPTION

Figure 1:
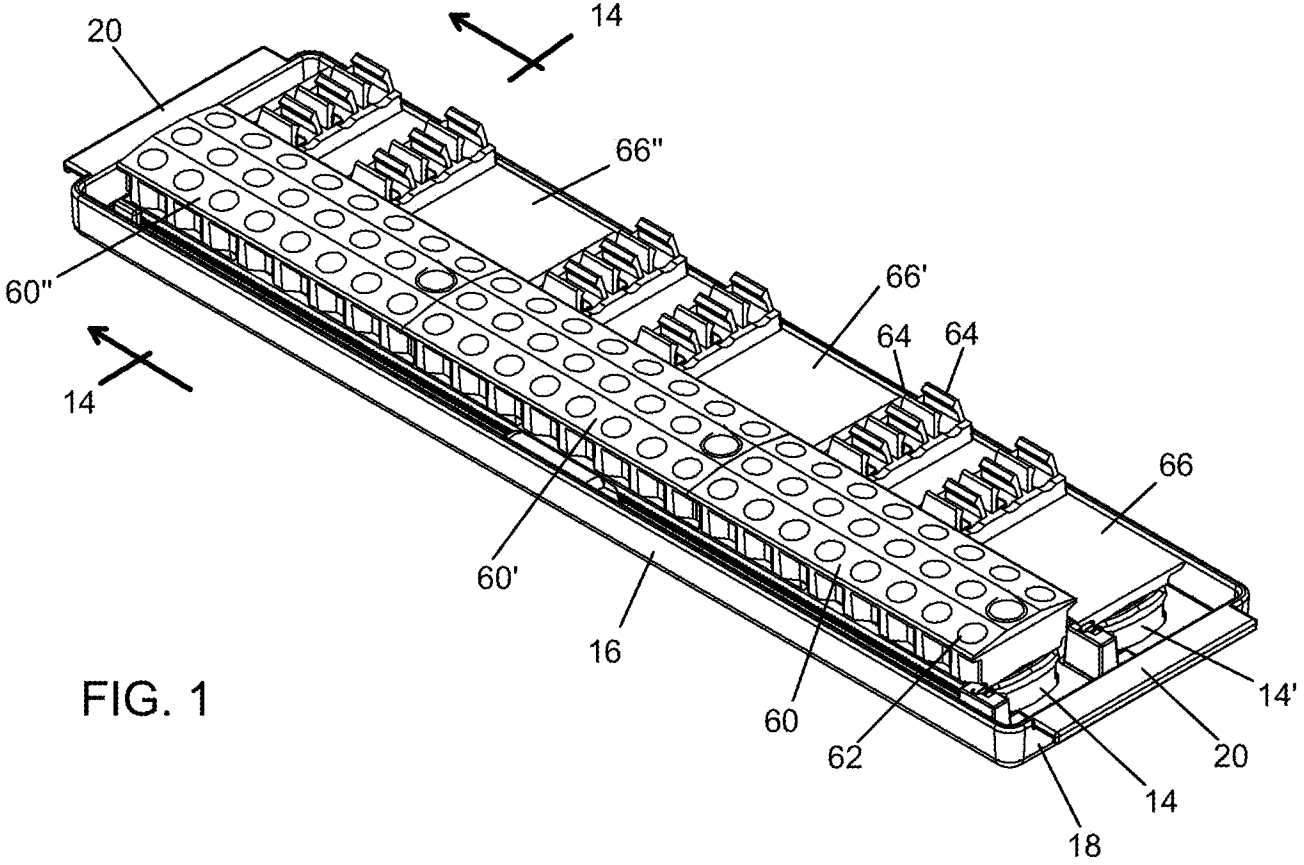
FIG. 1 is a perspective view of a bit organizer.

The system according to a preferred embodiment of the present disclosure comprises a system, method and device for holding a variety of bits/drivers of different shapes and sizes to allow organization in a tool box.

Referring to FIGS. 1-5, perspective, top, left side, right side and end views of the bit organizer, tray 12, the tray is suitably rectangular in overall shape, with elevated side members 16, 18 and end handle portions 20 for ease in carrying or moving the tray. The tray suitably receives one or more bit holder 60, 60', 60", having plural rows of bit receiving holes 62 defined therein. In the illustrated embodiment, a bit holder has 3 parallel rows of 8 bit receiving holes, although other configurations and organization of holes can be employed. Further, plural holder members 64 are mounted to the tray, the holders adapted to receive and hold items such as socket driver extensions and the like in a snap fit relationship. The holder members are mounted to a planar mounting surface 66, 66' and 66", and both the planar mounting surface 66 and the bit holders 60 are mounted atop rail members 14, 14'. The rail members are engaged by the tray and held in position by that engagement.

Figure 7:
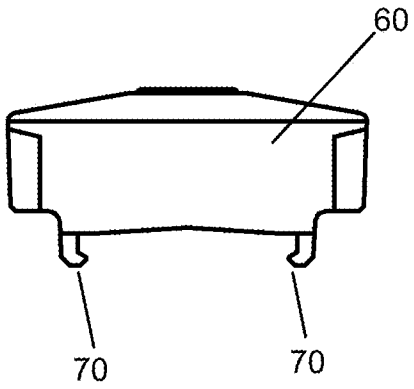
FIG. 7 is an end view of an individual bit holder component for smaller bits and drivers.

Referring to FIG. 7, an end view of an individual bit holder 60, the bottom of the bit holder has left and right engagement hooks 70 which are adapted to secure the bit holder to an individual rail 14, and mounting of the rail to the tray secures the bit holder to the tray.

Figure 8:
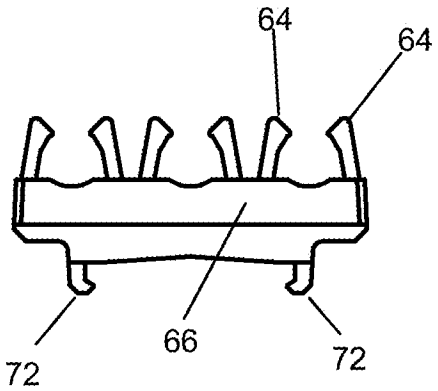
FIG. 8 is an end view of a snap fit individual bit holder component for longer bits and drivers.
Figure 9:
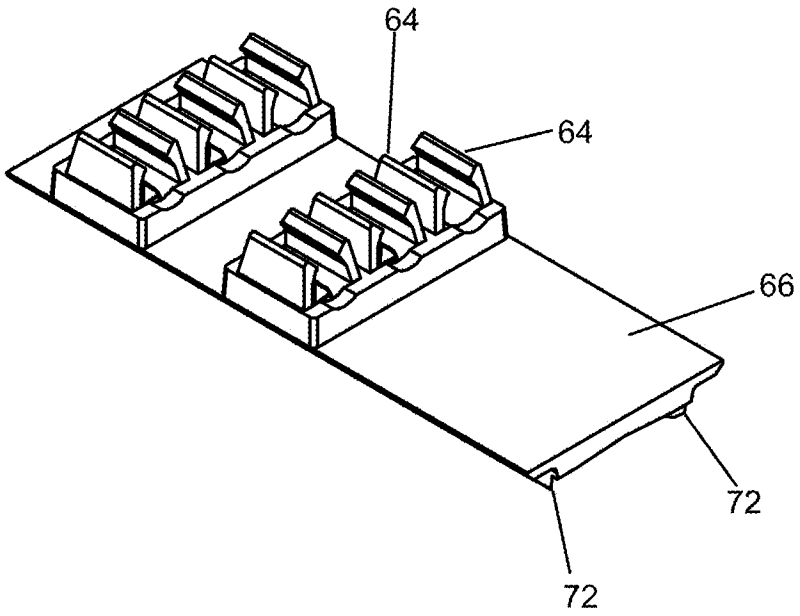
FIG. 9 is a perspective view of an individual bit holder component for longer bits.

Referring to FIG. 8, an end view of an individual bit holder 66, the bottom of the bit holder has left and right engagement hooks 72 which are adapted to secure the bit holder to an individual rail 14, and mounting of the rail to the tray secures the bit holder to the tray. FIG. 9 is a perspective view of an individual bit holder component for longer bits.

Figure 11:
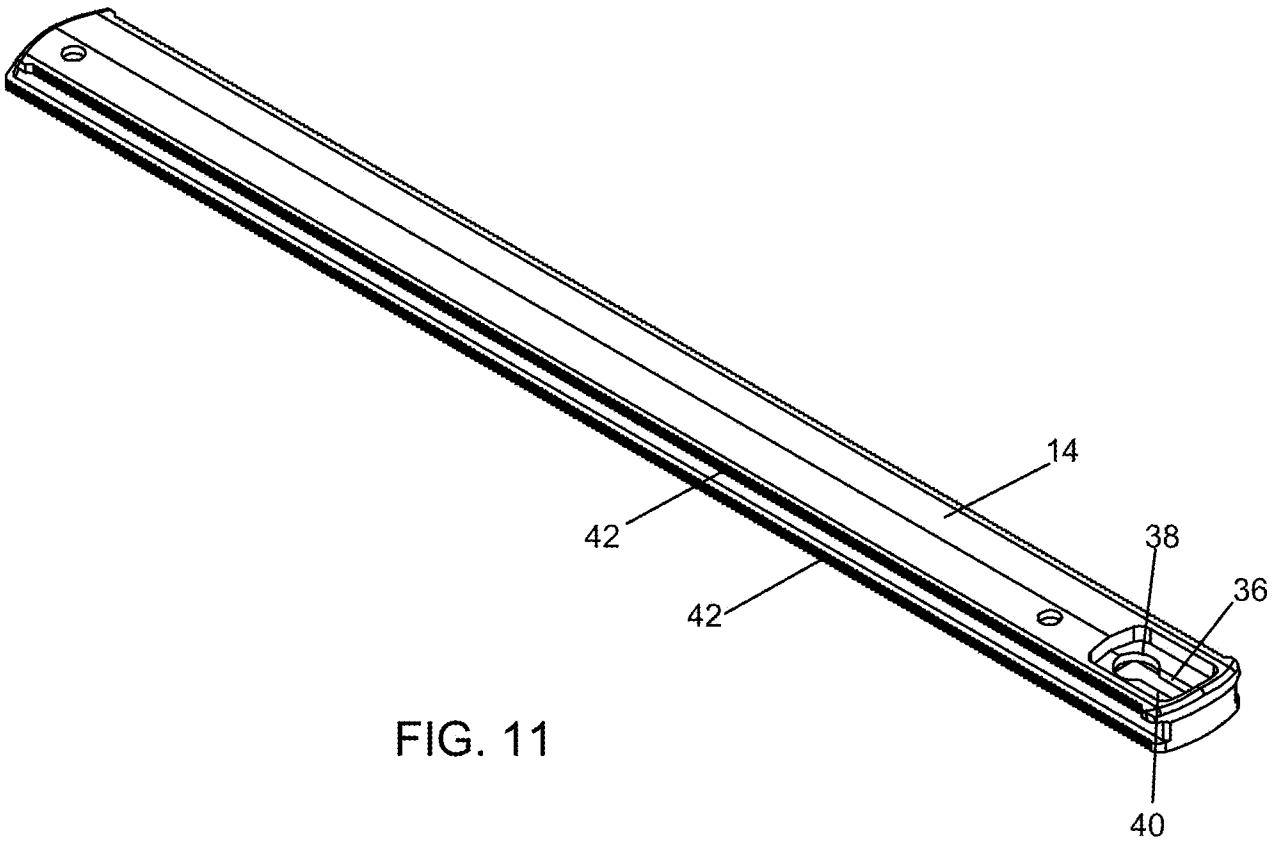
FIG. 11 is a perspective view of a mounting rail for mounting the bit holder to the tray.
Figure 12:
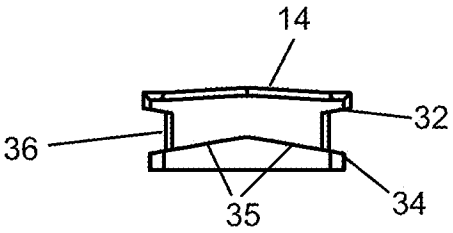
FIGS. 12 and 13 are end views of a mounting rail.
Figure 13:
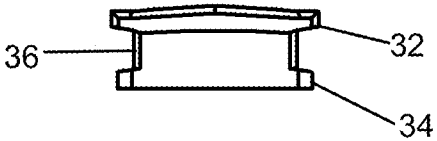

Referring to FIGS. 11, 12 and 13, perspective and left and right end views of a mounting rail 14, shoulder portions 35 defined in the end of rail 14 opposite from the end carrying curved edge profile 36, providing a slidable engagement profile into which the end of a rail 14 may be slid to engage the clips 46.

Additionally formed at the end of the rail carrying shoulder portions 34, 34', is an engagement slot 36 having a keyhole shape with a larger portion 38 formed inwardly with respect to the length of rail 14, transitioning to a narrower straight edged portion 40 as the slot extends more towards the outer end of the rail. The rails suitably have serrated edges 42 along the upper and lower side edges.

Figure 10:
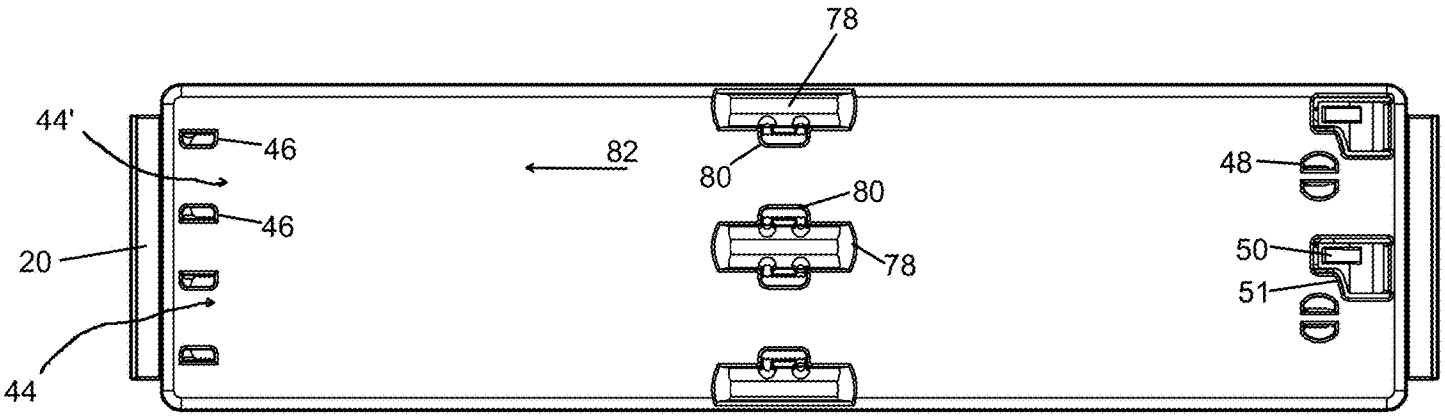
FIG. 10 is a top view of a mounting tray with bit holding components removed.
Figure 5:
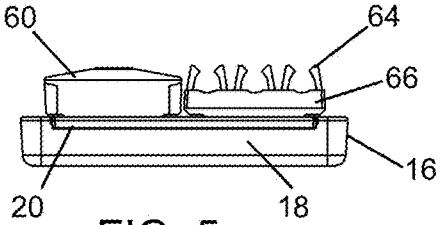
FIG. 5 is an end view of the bit organizer.
Figure 6:
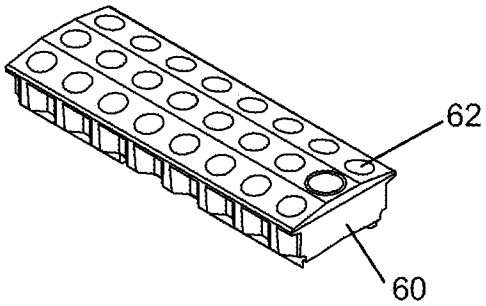
FIG. 6 is a perspective view of an individual bit holder component for smaller bits.

Referring to FIG. 10, is a top view of a mounting tray with bit holding components removed, a tray with corresponding features to that described in U.S. Pat. No. 9,364,949 is provided. Tray 12 has 2 rails receiving positions 44, 44' provided thereon. The tray is suitably rectangular in overall shape, with elevated side members 16, 18 and end handle portions 20 for ease in carrying or moving the tray. At one end of the tray, the 2 rail receiving positions 44, 44' comprise pairs of engaging clip members 46, an individual pair of clips 46 being spaced apart a sufficient distance to receive and end portion of a rail therein.

At the opposite end of the tray 12, a swedged peg member 48 is provided centrally of a rail receiving zone, and a deformable lock member 50 is positioned at an edge of the rail receiving zone, for removably locking a rail into place in the tray as discussed hereinbelow.

Deformable lock member 50 is suitably a 3-dimensional rectangular shaped member that is adapted to be depressed downwardly into the face of the tray, but biased to return to an undepressed position, with an engaging shoulder portion 51 defined along an interior edge thereof, shoulder portion having a curved edge profile that matches a curved edge profile of an end of a socket rail.

The individual sides of clip pair 46 are spaced from one another a sufficient distance to receive corresponding shoulder portions defined in the end of a rail opposite from the end carrying curved edge profile, providing a slidable engagement profile into which the end of a rail 14 may slide.

Centrally positioned on the surface of tray 12 is central region clip 78 which comprises left and right flexible shoulder engaging leaves 80, 80'. Leaves 80 are adapted to engage with the shoulder portion of rail 14, to assist in holding the central part of the rail to the tray when the rail is installed to the tray. The flexing configuration of the leaves enables the central portion of the rail to be pressed downwardly from above the leaves into engagement, or alternatively, the rail can be threaded through the leaves from below when sliding into engagement.

Swedged peg member 48 has flat lateral sides below the swedged portion, defining a size so as to closely engage in sliding fashion the region 40 of keyed region 36 in the rail.

To install a rail into the tray, a 'push-click-slide' type operation is typically performed, wherein the rail is moved toward the tray, opening 38 is positioned over swedged peg member 48 as the rail is lowered to mate with the face of the tray and the general central portion of the rail is pushed downwardly against the central clip 78 until the rail engages the flexible shoulder engaging leaves 80, 80', with a click sound, whereupon the rail is slided in the direction of arrow 82 until swedged peg member 48 engages with keyed region 36 and 40 and a shoulder portion of the lock member 50 engages with the end of the rail.

Simultaneously, the shoulder portions 34, 34' of the rail are slid into engagement with an individual clip pair 46. The bottom edge of the rail 14 rides over the upper surface of engaging shoulder portion 30, until such time as the distal end of the rail passes beyond shoulder portion 30, whereupon the bias of the shoulder portion causes it to move upwardly, whereby the edge of the shoulder portion blocks the rail from moving backwardly.

In use, bit holder 60 clips 64 and bit holder 66 clips 72 are adapted to engage with and fit between the upper shoulder portions 32 and lower shoulder portions 34 of a rail 14, whereby the bit holder can be secured to the rail and the rail mounted to the tray, thereby providing the tray with a bit holder component for receiving bits/drivers.

Figure 2:
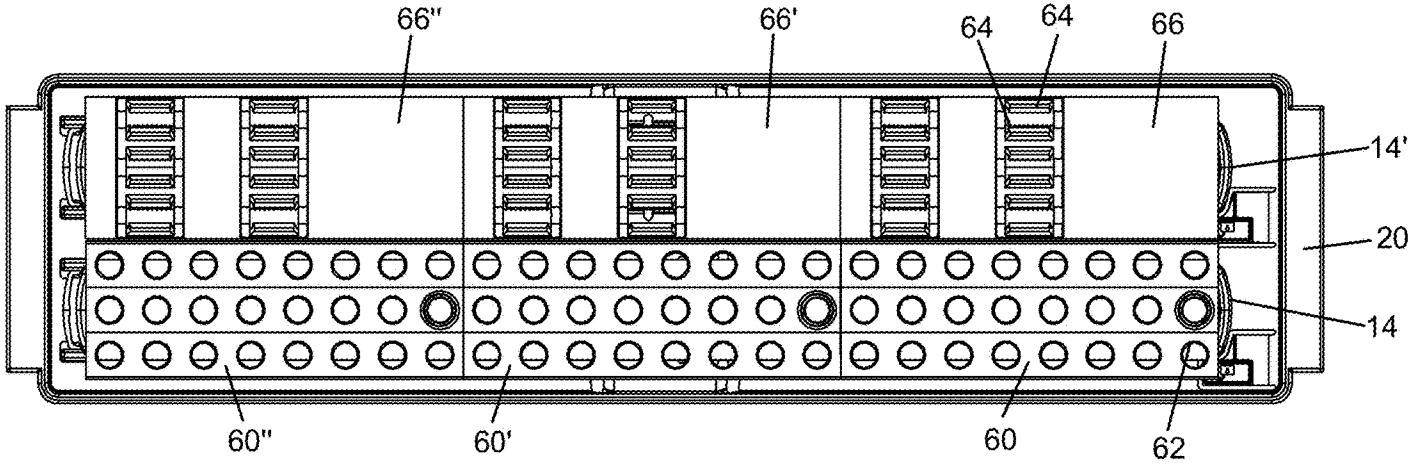
FIG. 2 is a top view of the bit organizer.
Figure 3:
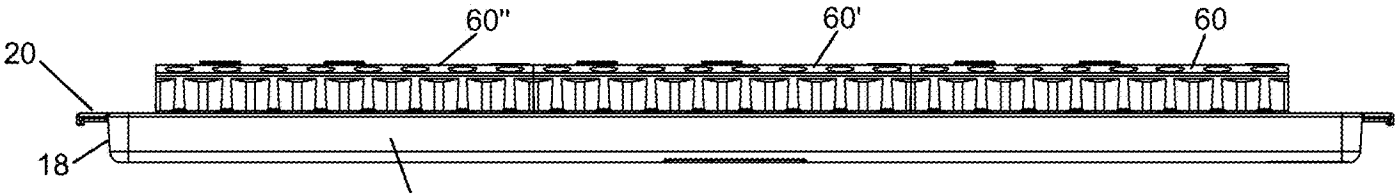
FIG. 3 is a left side view of the bit organizer.
Figure 4:
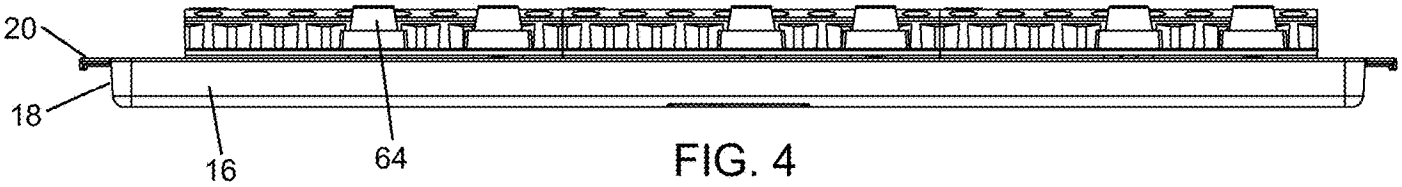
FIG. 4 is a right side view of the bit organizer.

In a particular embodiment, the tray and bit holders are sized such that 3 each of the smaller bit and larger bit holders fit on an individual rail 14, as illustrated in FIGS. 1 and 2. In the illustrations, like bit holders are attached to separate rails, resulting in the smaller bit holders being in one row and the larger bit holders in a second row, but this is not a requirement and depending on the individual user's requirements, the different holders can be mixed on an individual rail.

Figure 14:
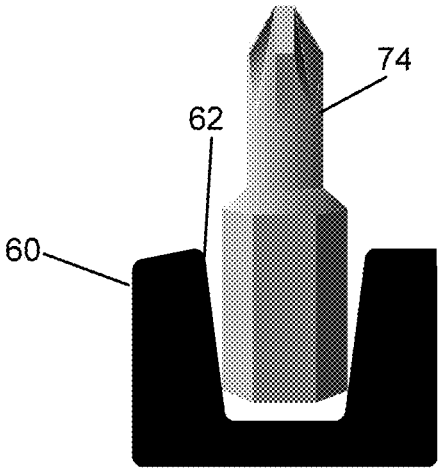
FIG. 14 is a partial sectional view of a bit holder taken along line 14-14 of FIG. 1 showing the frictional fit of a bit in the holder.

FIG. 14 is a cross section taken along line 14-14 of FIG. 1 of an individual receiving hole 62 in a bit holder 60, wherein the opening is tapered to be wider at the uppermost portion, narrowing slightly to the floor of the hole. The hole 62 is wider at its uppermost than the diameter of an individual bit 74, but narrower at the bottom of the hole than the diameter of the bit, so, that as the bit is inserted into the hole 62, a frictional fit forms between the bit and the walls of the hole, so as to hold the bit in the hole until it is removed by the user.

Figure 15:
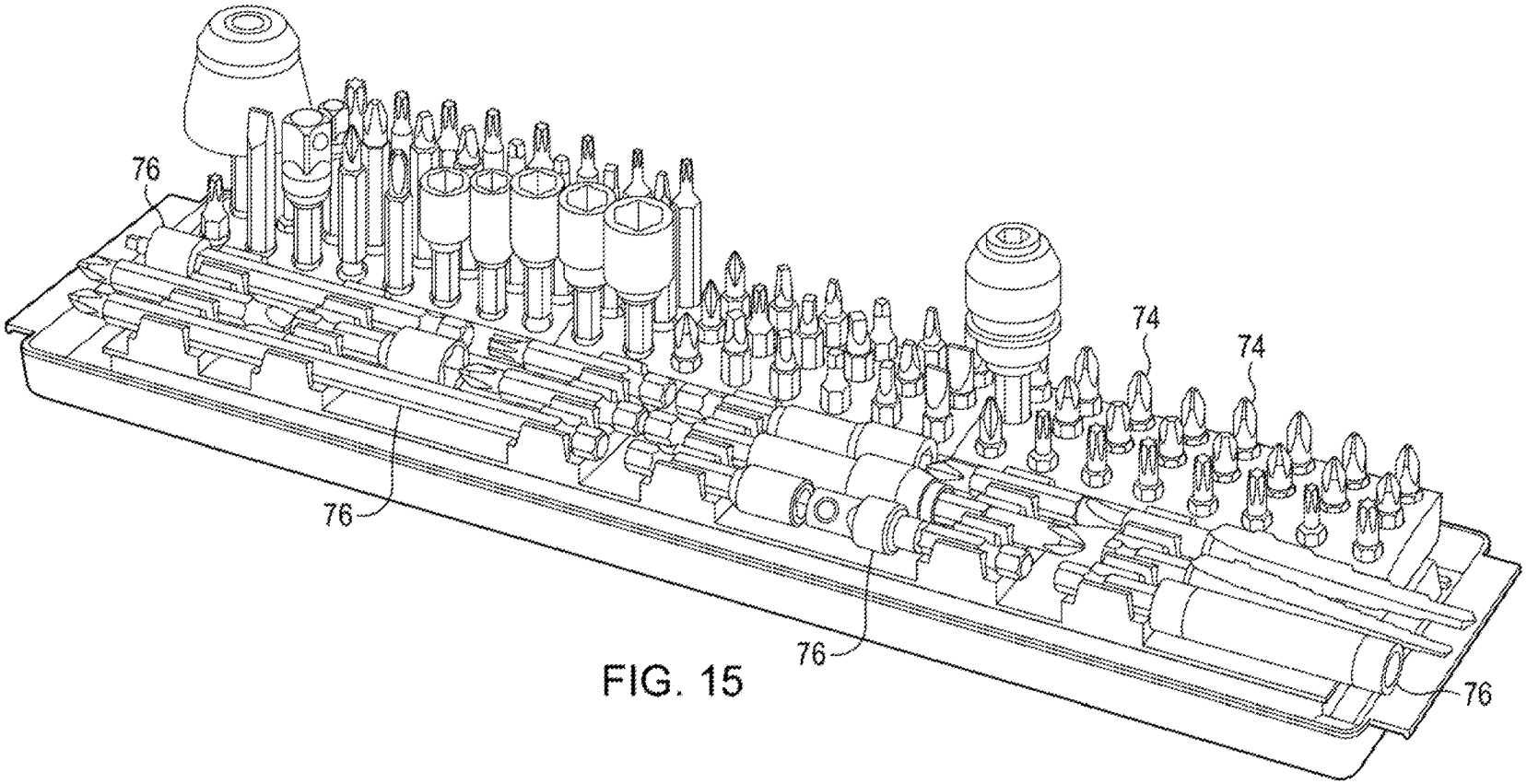
FIG. 15 is a perspective view of use of the bit organizer with a variety of bits installed therein.

FIG. 15 is a perspective view of use of the bit organizer with a variety of bits installed therein. Various shorter bits 74 are installed, as well as longer drivers or bits 76. The various bits and drivers and components are then held in organized fashion until the user wishes to remove one for use. Since the bits, etc. are presented in a visually convenient manner, the user is able to organize the bits in a manner that is best suited to the user's needs enabling the user to find the desired component much more quickly than if the bits and components were kept in an unorganized collection in the tool box.

While a preferred embodiment of the technology has been shown and described, it will be apparent to those skilled in the art that many changes and modifications may be made without departing from the broader aspects. The appended claims are therefore intended to cover all such changes and modifications as fall within the true spirit and scope of the technology.

What is claimed is:

1. A bit holder, comprising:

a bit receiving member having plural bit receiving holes therein for storing plural ones of bits; and a first elongate mounting rail for receivably holding the bit receiving member, wherein said bit receiving member has left and right engagement members that engage left and right lateral edge portions of the first elongate mounting rail for securing the bit receiving member to the first elongate mounting rail, wherein said left and right engagement members are left and right engagement hooks that engage left and right lateral edge portions of the first elongate mounting rail for securing the bit receiving member to the first elongate mounting rail;

plural holder members, arranged in spaced apart pairs, for removably securing elongate shaft members therebetween.

2. The bit holder according to claim 1, further comprising a receiving tray for removably holding the first elongate mounting rail with the first elongate mounting rail positioned between the bit receiving member and the receiving tray.

3. The bit holder according to claim 1, wherein said bit receiving member is adapted for holding bits of different lengths.

4. The bit holder according to claim 1, wherein ones of said bit receiving holes comprise a tapered profile with a wider diameter at an opening and a narrower profile towards an interior of said bit receiving holes.

5. The bit holder according to claim 1, wherein the bit receiving member is adapted to hold bits selected from one or more of square drive, phillips drive, plus drive, cross drive, slot drive, minus drive, Torx® drive, security Torx® drive, hex drive, double square drive, triple square drive, polydrive, spline drive, double hex drive, bristol drive, or pentalobe drive.

6. A bit holder comprising:

a rectangular tray member;

an elongate mounting rail adapted for removably securing to the rectangular tray;

a bit holder adapted to mount to the elongate mounting rail via left and right engagement hooks provided on the bit holder, said hooks engaging left and right lateral edge portions of the first elongate mounting rail for securing the bit holder to the elongate mounting rail, wherein said bit holder comprises plural openings adapted to receive a bit in respective ones of said plural openings and to removably secure the bit, ones of said openings comprising a tapered profile with a wider diameter at the openings and a narrower profile towards an interior of said openings.

7. The bit holder according to claim 6, further comprising plural snap members for removably receiving an elongate driver bit therein.

8. The bit holder according to claim 6, wherein the bit holder is adapted to hold bits selected from one or more of square drive, phillips drive, plus drive, cross drive, slot drive, minus drive, Torx® drive, security Torx® drive, hex drive, double square drive, triple square drive, polydrive, spline drive, double hex drive, bristol drive, or pentalobe drive.

9. An apparatus for arrangement and storage of bits and bit drivers, comprising:

a receiving tray;

at least 2 elongate rail members adapted for being removably secured to the receiving tray;

a bit holder adapted for mounting via first engagement members that interact with opposite lateral edges of a first one of the elongate rail members and for removably receiving driver bits therein in a vertical orientation;

a bit driver holder adapted for mounting via second engagement members that interact with opposite lateral edges of a second one of the elongate rail members and for removably receiving elongate bit drivers therein in a horizontal orientation, wherein said bit holder comprises plural openings having a tapered profile with a wider diameter at a mouth of said openings and a narrower profile towards an interior of said openings, and wherein said first and second engagement members comprise hooks.

10. The apparatus according to claim 9, wherein the bit holder is adapted to hold bits selected from one or more of square drive, phillips drive, plus drive, cross drive, slot drive, minus drive, Torx® drive, security Torx® drive, hex drive, double square drive, triple square drive, polydrive, spline drive, double hex drive, bristol drive, or pentalobe drive.

* * * * *